United States Patent [19]

Enghag

[11] 4,202,921

[45] May 13, 1980

[54] PROCESS FOR THE PREPARATION OF ROPE AND SPRING WIRE OF CARBON STEEL WITH AN IMPROVED CORROSION RESISTANCE

[75] Inventor: Per Enghag, Garphyttan, Sweden

[73] Assignee: Aktiebolaget Garphytte Bruk, Garphyttan, Sweden

[21] Appl. No.: 958,546

[22] Filed: Nov. 8, 1978

Related U.S. Application Data

[63] Continuation of Ser. No. 660,923, Feb. 24, 1976, abandoned.

[51] Int. Cl.[2] ..... C23C 1/02; C23C 1/04

[52] U.S. Cl. ..... 427/406; 427/433; 428/659

[58] Field of Search ..... 427/433, 406; 428/659

[56] References Cited

U.S. PATENT DOCUMENTS

| | | | |
|---|---|---|---|
| 909,869 | 1/1909 | Clamer | 427/433 |
| 1,948,505 | 2/1934 | Bray | 427/433 |
| 2,063,721 | 12/1936 | Bradley | 427/433 |
| 2,258,327 | 10/1941 | Kramer | 427/433 |
| 3,730,758 | 5/1973 | Laidman | 427/433 |

FOREIGN PATENT DOCUMENTS

| | | | |
|---|---|---|---|
| 2100332 | 7/1971 | Fed. Rep. of Germany | 427/433 |
| 2258589 | 6/1973 | Fed. Rep. of Germany | 427/433 |
| 2340413 | 2/1974 | Fed. Rep. of Germany | 427/433 |
| 679582 | 1/1930 | France | 427/433 |
| 11765 | 9/1971 | Sweden | 427/433 |
| 351977 | 6/1931 | United Kingdom | 427/433 |
| 512963 | 3/1938 | United Kingdom | 427/433 |
| 876032 | 8/1961 | United Kingdom | 427/433 |
| 1040916 | 9/1966 | United Kingdom | 427/433 |

OTHER PUBLICATIONS

Thomas, Stahl und Eisen (1966), Verlag Stahleisen, m.b.H in Düsseldorf, pp. 1481–1486.

Burns et al., Protective Coatings for Metals, Reinhold Pub. Corp., 1955 p. 169.

*Primary Examiner*—Ralph S. Kendall

*Attorney, Agent, or Firm*—Burns, Doane, Swecker & Mathis

[57] ABSTRACT

The invention refers to a process for the preparation of carbon steel wire for cables and springs and having an improved resistance to corrosion. The invention is characterized in that in a first step, a conventional hot galvanizing bath (bath No. 1) is used for plating, and in a second plating step, a bath (bath No. 2) is used consisting of an alloy of zinc and one or more of the metals Sn, Cd, Al, Pb, Cu and Ni, at a temperature not less than 30° C. and not more than 75° C. above the liquidus temperature of said alloy composition. The wire thus treated is used for the preparation of cables and springs.

3 Claims, No Drawings

PROCESS FOR THE PREPARATION OF ROPE AND SPRING WIRE OF CARBON STEEL WITH AN IMPROVED CORROSION RESISTANCE

This is a continuation, of application Ser. No. 660,923, filed Feb. 24, 1976, abandoned.

Steel wire for the manufacture of ropes and springs is generally prepared by so-called patenting and cold drawing of carbon steel. The wire is often protected against corrosion by a zinc coating. The best protection against corrosion is obtained by hot dipping in a zinc melt as a last operation. Cold drawing of the wire after the hot dipping decreases the thickness of the layer and thus the resistance to corrosion, but is often necessary in order to improve the surface so that making of ropes or coiling of springs can be carried out with a sufficient speed and precision.

There is a great need for a method of surface treatment giving an improved resistance of carbon steel wire to corrosion, even if the thickness of the plated layer is substantially reduced, such as by drawing.

Not only the thickness of the layer is, however, decisive for the corrosion protective effect, but also the electrode potential of the surface alloy in the corrosive solution is of great importance and so is the ability of the alloy to maintain its electrochemical activity so that the cathodic protective effect does not cease owing to formation of corrosion products changing the electrode potential in positive direction.

The present invention relates to a process for the preparation of carbon steel wire, in which wire is cold drawn, in different steps. One step of the process is a conventional hot-dip galvanizing using a zinc bath, and a second step is a subsequent surface alloying in a melt of an alloy containing zinc and other metals, selected in such a way that a strong improvement of the corrosion protective effect is obtained. This second surface alloying step can be the final operation, but—and that is generally the case—it can be followed by cold drawing to a final size and hardness.

It previously was known to prepare protective coatings in two steps, the first one being hot dip galvanizing. In a process of this type such metals as Cd, Sn, Al, Bi, which have a very low tendency to form alloys with steel, can be bonded to the wire through their pronounced tendency to form alloys with zinc. However, the use of such processes in the manufacture of wires for ropes, springs, etc. has been impossible for several reasons.

Through the present invention the different obstacles have been removed.

According to the invention, the protective coating of the carbon steel wire is prepared by hot dipping in two steps. The first one is a conventional hot dip galvanizing in a bath of molten zinc (melt No. 1) and the second one is a treatment in a bath at a molten alloy (melt No. 2) consisting of zinc and one or several of the metals Sn, Cd, Al, Pb, Cu and Ni. The treatment in the melt No. 2 bath is carried out at a temperature of minimum 30° C. and maximum 75° C. above the liquidus temperature for the actual alloy composition of said melt.

It has been found suitable that melt No. 2 contains tin, cadmium or both, and has a zinc content of 2–40%, preferably 4–40%.

When the melt No. 2 contains aluminum, a content of 1–10% of said alloying component has been found to be suitable.

In addition to this, it has been found suitable that the contents of the alloying metals in melt No. 2—besides zinc—are restricted as follows:

| | | |
|---|---|---|
| Pb | 2 | −10% |
| Cu | 0.5 | −2% |
| Ni | 0.5 | −2% |
| Si | 0.01 | −0.10% |

All the preceding and following percentages relate to weight percent.

An obstacle to the application of the two-step process has been the fact that melt No. 2 earlier has consisted of a pure metal, such as tin. Thus, the two step treated steel object appeared in a corroding solution with a high electrode potential determined by the external layer, and no cathodic protection has been given to the steel. Surprisingly, it has now been found that the electrode potential of, for example, tin can be radically lowered by an addition of a minimal content of zinc to the bath providing the external layer.

EXAMPLE 1.

A series of melts of tin and zinc having the following composition was prepared:

| Melt No. | % by weight Zn | % by weight Sn | Potential after 5 min. in a 5% NaCl solution at pH 6.5, mV |
|---|---|---|---|
| 1 | 0.09 | 99.91 | −240 |
| 2 | 0.28 | 99.72 | −270 |
| 3 | 0.44 | 99.56 | −290 |
| 4 | 0.93 | 99.07 | −730 |
| 5 | 1.56 | 98.44 | −790 |
| 6 | 2.2 | 97.8 | −790 |
| 7 | 7.7 | 92.3 | −800 |

Note: The potential of steel tested in the same way was - 335 mV.

The electrode potential of the melt material after 5 min. in a 5% water solution of NaCl is indicated in the table.

Thus, the melt material apparently changes its character abruptly from "noble" to "unnoble" compared to steel at a zinc content of about 0.5–1.0%.

The example illustrates that if the second melt consists of tin with at least 1% of Zn, the electrode potential can be directed to a value lying clearly below that of the steel but above that of the zinc, whereby an increased corrosion protective effect can be expected.

EXAMPLE 2.

To test the effect discovered in example 1, a spring wire having 0.85% C was patented and cold drawn. Thereafter it was surface treated in two steps, the first of which was a conventional hot-dip galvanizing. In the second step, melts according to the table below were used. After the tests the indicated electrode potentials were measured in a 5% NaCl solution.

| Test No. | Composition of the alloy in step 2 | Potential after 5 min. in 5% NaCl solution at pH 6.5, mV |
|---|---|---|
| 1 | 0.1% Zn, 99.9% Sn | −240 |
| 2 | 2% Zn, 98% Sn | −300 |
| 3 | 8% Zn, 50% Sn, 42% Cd | −630 |
| 4 | 10.9% Zn, 40% Sn, 49% Cd, 0.1% Cu | −590 |
| 5 | 9% Zn, 44% Sn, 42% Cd, 5% Pb | −610 |

-continued

| Test No. | Composition of the alloy in step 2 | Potential after 5 min. in 5% NaCl solution at pH 6.5, mV |
|---|---|---|
| 6 | 59% Zn, 41% Cd | −760 |
| 7 | 59% Zn, 41% Sn | −760 |

Note:
The potential of the steel itself is about - 335 mV.

The sample illustrates that the effect disclosed in example 1 also appears in a real two-step hot dipping process, but that the minimum content of zinc must be raised to somewhat above 2%.

The addition of aluminum by a two-step process has not been carried out in practice heretofore, owing to the high melting temperature of aluminum and al-rich alloys, which influences the mechanical properties of the cable or the spring wire unfavorably. If one wishes to maintain a low melt temperature, the Al content of the melt must be severely restricted. It has now surprisingly been found that if a wire after a hot-dip galvanizing is passed throuugh a zinc or a zinc alloy melt containing Al in an amount lower than the composition of the Zn-Al-eutectic, i.e. a lower Al content than 5%, aluminum will be enriched on the wire surface, provided that the wire is cooled and activated in a suitable manner between steps 1 and 2. The activation can be carried out in such a way that the wire after the hot-dip galvanizing is quenched and then treated with an acid solution, or is electrochemically treated in an acid, neutral or alkaline solution. The activation is preferably carried out in a water bath containing from 1 to 5 g hydrochloric acid and from 30 to 200 g ammonium chloride per liter solution at a temperature from 30 to 60° C. and for a time of 2 to 6 seconds.

EXAMPLE 3.

A steel rope wire containing 0.65% C was patented and cold drawn. Then it was surface treated in two steps. In the second step, an Al-containing zinc-tin melt was used, consisting of 89% Zn, 8% Sn and 3% Al. In this way, a wire, the electrode potential of which in 5% NaCl solution was—0.77 volt, was obtained. The resistance to corrosion in a salt spray (accelerated test according to ASTM B 117) was more than 100 hours. Through the combination of a pure zinc layer from step 1 and a layer of about the same thickness from step 2, it could be expected that the average aluminum content of the total layer would decrease from about 3 to about 1.5%. By accurate analysis of the layer by means of atomic absorption spectroscopy, Al contents in the layer within the range 9.6 to 13.0% were obtained in repeated tests of the same wire and repeated running of the whole process.

An additional obstacle to the application of the two-step process has been the lack of clarity regarding the control of the two possible and simultaneously running reactions in step 2. On one hand, a zinc dissolution from the wire is obtained, which if it is too pronounced, gives raw surfaces and a continuously changing composition of melt 2, and on the other hand, alloy metal is picked up from melt 2 into the layer, which if it is too pronounced as a result gives thick layers having an unsatisfactory drawability. It has now been found that the temperature of melt No. 2 must be adjusted in view of the position of the liquidus line as to the composition of the alloy in question, so that the temperature of the bath is adjusted not less than 30° C. and not more than 75° C. above said liquidus temperature. The treatment in the melt No. 2 is carried out for a time of 2 to 200 seconds, for instance 5 to 100 seconds, and preferably 10 to 60 seconds.

EXAMPLE 4.

Carbon steel wire (0.80% C) was patented at a size of 5.5 mm and reduced by cold drawing to 3.0 mm diameter (70% reduction). The wire was surface treated in two steps with zinc in the first step and zinc-cadmium in the second one (17% Zn, 83% Cd). Then the processing was terminated by cold drawing to a diameter of 2.0 mm (87% total reduction). A parallel sample of the same wire was drawn to 3.0 mm, was conventionally hot-dip galvanized and was drawn to a diameter of 2.0 mm. Both wire types were tested in a salt spray test ASTM B 117 for 96 hours. The conventional galvanized wire was severely corroded, but the two-step treated one had not been attacked by any red rust.

EXAMPLE 5.

From the two-step treated wire in example 4, a 19-wire rope was manufactured, which at its ends was supplied with stainless fittings. The fittings and the rope were tested for 288 hours in a salt spray test. No corrosion was observed, not even in the contact interfaces between the stainless fittings and the surface alloyed rope.

EXAMPLE 6.

From the wire in example 4, helical springs were manufactured in an automatic spring coiler. The wire turned out to have such mechanical properties that it was very well suited for the preparation of springs. A corrosion test for 150 hours in salt spray gave acceptable results. The cutting of the wire in the manufacture left uncoated steel surfaces at the ends of the springs. Not even these ends were affected. The formation of rust was prevented by the cathodic protective effect of the layer.

What is claimed is:

1. In a two-step dipping process for the preparation of corrosion-resistant carbon steel wire the first step of which (melt No. 1) is a conventional hot-dip galvanizing in a first bath of zinc, the improved second step which comprises treating the wire from the first bath in a second bath of a molten alloy composition (melt No. 2) consisting essentially of 2 to 40% by weight of zinc and at least one of the alloying elements of the group consisting of Sn, Cd, Al, Pb, Cu, Si, and Ni, at least one of the alloying elements Sn and Cd being present in said alloy composition, at a temperature of not less than 30° C. and not more than 75° C. above the liquidus temperature for the alloy composition of said second bath, and wherein the alloying elements Pb, Cu, Ni, and Si may be present in amounts ranging up to 10%, 2%, 2%, and 0.10% by weight respectively.

2. The improved process of claim 1, wherein melt No. 2 contains 1 to 10% of aluminum.

3. The improved process of claim 1, wherein melt No. 2 contains up to 5% by weight of Al, and wherein between said first step and said second step the wire is activated by being cooled and then treated with an acid solution or electrochemically treated in an acid, neutral, or alkaline solution thereby promoting enrichment in Al content of the deposit resulting from said second step.

* * * * *